US010258814B2

(12) United States Patent
Casebolt et al.

(10) Patent No.: US 10,258,814 B2
(45) Date of Patent: Apr. 16, 2019

(54) BREAKAWAY KEEPER

(71) Applicant: D B Industries, LLC, Red Wing, MN (US)

(72) Inventors: Scott C. Casebolt, St. Paul Park, MN (US); Judd J. Perner, Red Wing, MN (US)

(73) Assignee: D B Industries, LLC, Maplewood, MN (US)

( * ) Notice: Subject to any disclaimer, the term of this patent is extended or adjusted under 35 U.S.C. 154(b) by 0 days.

(21) Appl. No.: 14/805,017

(22) Filed: Jul. 21, 2015

(65) Prior Publication Data

US 2016/0361578 A1 Dec. 15, 2016

Related U.S. Application Data

(60) Provisional application No. 62/173,823, filed on Jun. 10, 2015.

(51) Int. Cl.
*A62B 35/00* (2006.01)
*A45F 5/02* (2006.01)

(52) U.S. Cl.
CPC ..... *A62B 35/0037* (2013.01); *A45F 5/02* (2013.01); *A62B 35/0075* (2013.01); *A45F 5/021* (2013.01); *A45F 2200/0575* (2013.01)

(58) Field of Classification Search
CPC . B60R 22/30; Y10T 24/4014; Y10T 24/4016; Y10T 24/1397; Y10T 24/318; Y10T 24/4072; Y10T 24/45529; Y10T 24/45696; Y10T 24/45785; Y10T 403/4327; A45F 5/00; A41F 15/02; B60N 2/2806; B60N 2/286; B60P 7/0823; B60P 7/0846; B65D 63/1018; F16G 11/14; F16L 3/2332; A44B 11/04; A44B 11/00
See application file for complete search history.

(56) References Cited

U.S. PATENT DOCUMENTS 1,464,659 A 8/1923 Keely
2,274,795 A * 3/1942 Klock ..... A41H 37/08 223/49
3,584,606 A * 6/1971 Reidhead ..... A01K 15/003 119/805
3,629,908 A * 12/1971 Phillips ..... F16G 11/14 24/288
4,893,835 A * 1/1990 Linden ..... B60R 22/024 280/808
4,932,626 A * 6/1990 Guillot ..... A47G 25/06 24/306
5,201,099 A * 4/1993 Campbell ..... A44B 11/04 24/186
5,579,561 A * 12/1996 Smith ..... B60N 2/2806 24/170

(Continued)

FOREIGN PATENT DOCUMENTS

DE 29911565 9/1999

*Primary Examiner* — Abigail E Troy
*Assistant Examiner* — David M Upchurch

(57) ABSTRACT

A breakaway keeper includes a base and a loop portion. The base is configured and arranged to engage a strap. The loop portion extends outward from the base to form a channel configured and arranged to receive a portion of a connector. The loop portion is configured and arranged to be engaged by the connector and deform and release the connector when subjected to a predetermined force.

6 Claims, 2 Drawing Sheets

(56) References Cited

U.S. PATENT DOCUMENTS

| | | | | |
|---|---|---|---|---|
| 5,601,356 | A * | 2/1997 | McWilliams | A45F 5/00 224/221 |
| 5,806,469 | A * | 9/1998 | Cooper-Ratliff | A01K 15/04 119/772 |
| 5,826,413 | A * | 10/1998 | Bostock | B68C 3/02 54/49 |
| 6,199,729 | B1 | 3/2001 | Drzymkowski | |
| 6,382,138 | B1 * | 5/2002 | Campbell | A01K 15/003 119/712 |
| 7,100,248 | B2 * | 9/2006 | Crook | B65D 63/1018 24/16 PB |
| 7,107,657 | B1 * | 9/2006 | Howell | A44B 11/263 24/614 |
| 7,171,731 | B1 * | 2/2007 | Borcherding | B60P 7/0823 24/265 CD |
| 2002/0023319 | A1 * | 2/2002 | Griffith | A41F 15/02 24/163 R |
| 2004/0093700 | A1 * | 5/2004 | Frangesh | A44B 11/04 24/169 |
| 2004/0255434 | A1 * | 12/2004 | Howell | A44B 11/00 24/194 |
| 2008/0156839 | A1 | 7/2008 | Betcher et al. | |
| 2009/0255095 | A1 * | 10/2009 | Gillard | A45F 5/00 24/3.13 |
| 2012/0019043 | A1 | 1/2012 | Merrill | |
| 2013/0298354 | A1 * | 11/2013 | Campbell | B60R 22/024 24/191 |
| 2014/0216472 | A1 * | 8/2014 | Brace | A44B 11/065 128/863 |

* cited by examiner

BREAKAWAY KEEPER

CROSS-REFERENCE TO RELATED APPLICATION

This application claims the benefit of U.S. Provisional Patent Application Ser. No. 62/173,823 filed Jun. 10, 2015, which is hereby incorporated by reference.

BACKGROUND OF THE INVENTION

People who work at heights commonly don safety harnesses, which are connected to anchorage structures via lifelines or lanyards. Sometimes people use lanyards to temporarily connect to support structures while repositioning their lifelines. This is to ensure 100% tie-off. Commonly both lifelines and lanyards are connected to the users' dorsal D-rings. When not in use, the distal ends of the lanyards are connected to the users' harnesses, however, this could create safety hazards should the lanyards get caught and prevent the lifelines from functioning properly.

For the reasons stated above and for other reasons stated below, which will become apparent to those skilled in the art upon reading and understanding the present specification, there is a need in the art for a breakaway keeper.

BRIEF SUMMARY OF THE INVENTION

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, a breakaway keeper comprises a base and a loop portion. The base is configured and arranged to engage a strap. The loop portion extends outward from the base to form a channel configured and arranged to receive a portion of a connector. The loop portion is configured and arranged to be engaged by the connector, and the loop portion is configured and arranged to deform and release the connector when subjected to a predetermined force.

In one embodiment, a breakaway keeper for use with a safety harness comprises a base and a loop portion. The base is configured and arranged to engage a strap of the safety harness. The loop portion extends outward from the base to form a channel configured and arranged to receive a portion of a safety device. The loop portion is configured and arranged to be engaged by the safety device, and the loop portion is configured and arranged to deform and release the safety device when subjected to a predetermined force.

In one embodiment, a breakaway keeper for use with a safety harness comprises a base and a loop portion. The base is configured and arranged to engage a strap of the safety harness, and the base includes a bar portion positioned proximate a first side of the strap and an extension member positioned proximate a second side of the strap. The loop portion includes a first arm and a second arm. The first and second arms extend outward from the base to form a channel configured and arranged to receive a portion of a safety device. The first arm extends outward from a first side of the base, and the second arm extends outward from a second side of the base. Respective distal ends of the first arm and the second arm form a weakened portion. At least one of the first and second arms is configured and arranged to be engaged by the safety device and deform and release the safety device when subjected to a predetermined force.

BRIEF DESCRIPTION OF THE DRAWINGS

The present invention can be more easily understood, and further advantages and uses thereof can be more readily apparent, when considered in view of the detailed description and the following Figures in which.

In accordance with common practice, the various described features are not drawn to scale but are drawn to emphasize specific features relevant to the present invention. Reference characters denote like elements throughout the Figures and the text.

DETAILED DESCRIPTION OF THE INVENTION

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Embodiments of the present invention provide a breakaway keeper for interconnecting a strap and a device. For example, a strap could be a strap of a safety harness, and the device could be a safety device such as but not limited to a lifeline or a lanyard. The breakaway keeper is configured and arranged to deform when subjected to a predetermined force so that the device does not get caught and, therefore, prevent a user's lifeline from functioning properly. In addition to making sure the user's lifeline functions properly, the breakaway feature is intended to limit the force applied to the user's body during a fall when an unused leg of a Y-lanyard or self-retracting lifeline becomes taught and to reduce tripping and entanglement hazards.

The term "deform" is being used herein to describe any type of deformation including but not limited to at least temporary deforming, deflecting, breaking, and the like.

Figure 1:
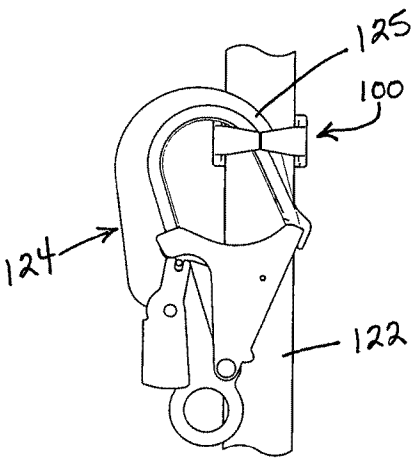
FIG. 1 is a front view of a breakaway keeper interconnecting a lanyard and a strap of a safety harness constructed in accordance with the principles of the present invention.
Figure 2:
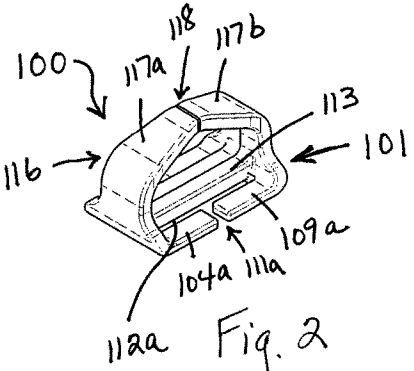
FIG. 2 is a perspective view of the breakaway keeper shown in FIG. 1.
Figure 5:
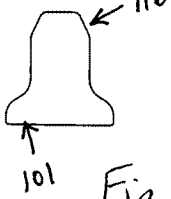
FIG. 5 is a side view of the breakaway keeper shown in FIG. 3.
Figure 6:
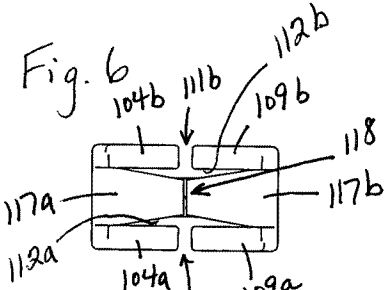
FIG. 6 is a front view of the breakaway keeper shown in FIG. 3.
Figure 3:
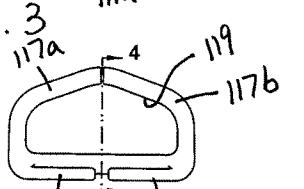
FIG. 3 is a bottom view of the breakaway keeper shown in FIG. 1.
Figure 7:
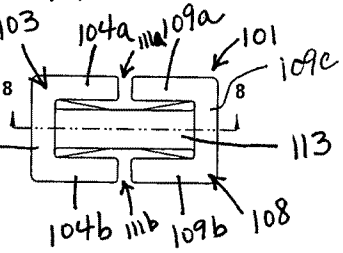
FIG. 7 is a rear view of the breakaway keeper shown in FIG. 3.
Figure 8:
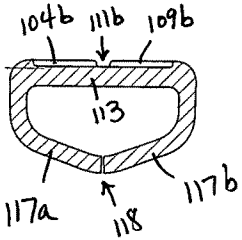
FIG. 8 is a cross-section view of the breakaway keeper taken along the lines 8-8 in FIG. 7.
Figure 4:
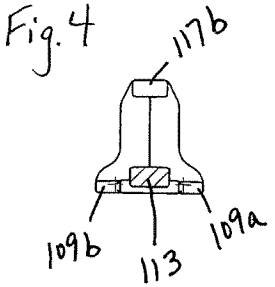
FIG. 4 is a cross-section view of the breakaway keeper taken along the lines 4-4 in FIG. 3.

One embodiment breakaway keeper 100 is shown interconnecting a strap 122 of a safety harness and a snap hook 124 in FIG. 1. The snap hook 124 could be connected to a lanyard or other suitable safety device. The breakaway keeper 100 is shown connected to a strap 122 of a safety harness in FIGS. 9 and 10.

The breakaway keeper 100 is shown in FIGS. 2-8 and includes a base 101 and a loop portion 116. The base 101 includes a bar portion 113 and an extension member between which the strap 122 is routed. Preferably, the strap 122 is captured between the bar portion 113 and the extension member such that the breakaway keeper 100 does not readily slide along the length of the strap 122. Preferably, the extension member is configured and arranged for easy, retrofit attachment to the strap 122 without disassembling the safety harness.

The extension member includes a first U-shaped portion 103 and a second U-shaped portion 108. The first U-shaped portion 103 includes an intermediate portion 104*c* interconnecting extensions 104*a* and 104*b* that extend outward from opposing ends of the intermediate portion 104*c*. The second U-shaped portion 108 includes an intermediate portion 109*c* interconnecting extensions 109*a* and 109*b* that extend outward from opposing ends of the intermediate portion 109*c*. The intermediate portions 104*c* and 109*c* are operatively connected to opposing ends of the bar portion 113, the extensions 104*a* and 109*a* extend toward each other proximate one side of the bar portion 113, and the extensions 104*b* and 109*b* extend toward each other proximate the other side of the bar portion 113. The extensions 104*a* and 109*a* form a slot 111*a*, and extensions 104*b* and 109*b* form a slot 111*b*. A slot 112*a* is formed between the bar portion 113 and the extensions 104*a* and 109*b*, and a slot 112*b* is formed between the bar portion 113 and the extensions 104*b* and 109*b*.

The loop portion 116 is operatively connected to the base 101 and includes an arm 117*a* extending outward proximate one end of the bar portion 113 opposite extensions 104*a* and 104*b* and an arm 117*b* extending outward proximate the other end of the bar portion 113 opposite extensions 109*a* and 109*b*. The arms 117*a* and 117*b* curve toward one another to form a weakened portion 118, which in this embodiment is a slot positioned between the distal ends of the arms. The weakened portion 118 could also include a score line or other suitable connection that would deform when subjected to a predetermined force. Between the arms 117*a* and 117*b* and the bar portion 113 is a channel 119 configured and arranged to receive a hook portion 125 of a snap hook 124 or any other suitable connector of a safety device.

Although any suitable material could be used, in this embodiment, at least the loop portion 116 is made of nylon. In this embodiment, the base 101 and the loop portion 116 are integral and made of nylon.

Figure 9:
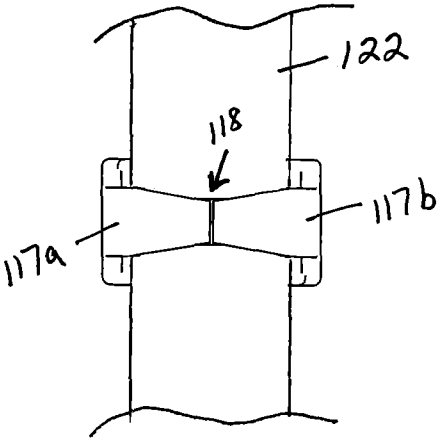
FIG. 9 is a front view of the breakaway keeper shown in FIG. 1 connected to a strap of a safety harness.
Figure 10:
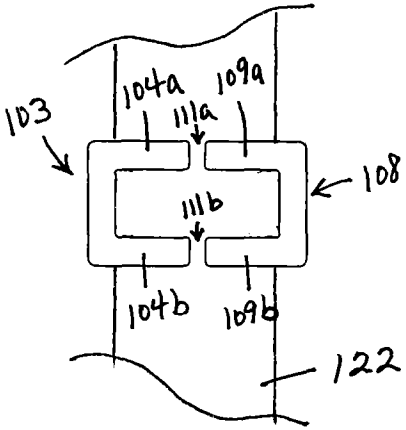
FIG. 10 is a rear view of the breakaway keeper shown in FIG. 1 connected to a strap of a safety harness.

The breakaway keeper may be retrofittable for easy connection to a variety of straps. To connect the breakaway keeper 100 to a strap, such as a safety harness strap 122, a side of the strap is inserted through the slots 111*a* and 111*b* and then slid into one side of the slots 112*a* and 112*b*. Then the other side of the strap is inserted through the slots 111*a* and 111*b* and then slid into the other side of the slots 112*a* and 112*b*. The strap is then positioned in the slots 112*a* and 112*b* with the bar portion 113 positioned proximate one side of the strap and the extensions 104*a*, 104*b*, 109*a*, and 109*b* positioned proximate the other side of the strap. This is shown in FIGS. 9 and 10. In other words, the base 101 includes a bar portion and an extension member forming a path through which the strap is routed to engage the strap. In this embodiment, the extension member includes a first U-shaped portion and a second U-shaped portion forming a slot through which the strap is inserted to position the strap between the bar portion and the extension member.

A connector of a safety device, in this embodiment a snap hook 124 of a lanyard (not shown), is connected to the loop portion 116. If the weakened portion 118 is a slot, the arms 117*a* and 117*b* could at least temporarily deform so that the hook portion 125 could be positioned within the channel 119 when not in use, as shown in FIG. 1. Alternatively, the gate of the snap hook 124 could be opened to position the hook portion 125 in the channel 119 and then closed to prevent the snap hook 124 from being released from the breakaway keeper 100.

Should the lanyard or other safety device get caught on something, the arms 117*a* and 117*b* are configured and arranged to at least temporarily deform, the weakened portion 118 deforms to release the lanyard or other safety device from the breakaway keeper 100. Therefore, the lanyard or other safety device will not interfere with the proper function of the user's lifeline or other fall protection equipment.

The above specification, examples, and data provide a complete description of the manufacture and use of the composition of embodiments of the invention. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the invention. Therefore, it is manifestly intended that this invention be limited only by the claims and the equivalents thereof.

The invention claimed is:

1. A breakaway keeper in combination with a safety harness and a safety device, the breakaway keeper comprising:

a base engaged with a strap of the safety harness, the base comprising a bar portion positioned proximate a first side of the strap and comprising a first end, an opposite second end, and first and second sides extending from the first end to the second end; and an extension member positioned proximate a second side of the strap, the bar portion and the extension member forming a path therebetween the extension member comprising a slot providing access to the path, the slot configured and arranged to receive a portion of the strap for insertion of the strap into the path through which the strap is routed; and a loop portion comprising a first arm extending upwardly from the base adjacent the first end of the bar portion and a second arm extending upwardly from the base adjacent the second end of the bar portion, the first and second arms forming a channel that receives a portion of the safety device, wherein respective distal ends of the first arm and the second arm form a weakened portion, and wherein at least one of the first and second arms is engaged with the safety device and is deformable to release the safety device when subjected to a predetermined force.

2. The combination of claim 1, wherein the extension member includes a first U-shaped portion and a second U-shaped portion forming the slot through which the strap is inserted to position the strap between the bar portion and the extension member.

3. The combination of claim 1, wherein the weakened portion is a slot configured and arranged to allow the first and second arms to separate when subjected to the predetermined force.

4. The combination of claim 1, wherein the weakened portion is a score line configured and arranged to deform and allow the first and second arms to separate when subjected to the predetermined force.

5. The combination of claim 1, wherein at least the loop portion is made of nylon.

6. The combination of claim 1, wherein the base and the loop portion are integral.

* * * * *